United States Patent [19]

Guy et al.

[11] Patent Number: 4,609,307

[45] Date of Patent: Sep. 2, 1986

[54] ANODE POD SYSTEM FOR OFFSHORE STRUCTURES AND METHOD OF INSTALLATION

[75] Inventors: Arthur L. Guy; John R. Plugge, both of Houston, Tex.

[73] Assignee: Exxon Production Research Co., Houston, Tex.

[21] Appl. No.: 669,692

[22] Filed: Nov. 5, 1984

[51] Int. Cl.[4] ..... E02B 17/00; C23F 13/00

[52] U.S. Cl. ..... 405/211; 204/148; 204/197

[58] Field of Search ..... 405/195, 203, 211, 216, 405/224; 114/222, 265; 204/147, 148, 196, 197

[56] References Cited

U.S. PATENT DOCUMENTS

| | | | |
|---|---|---|---|
| 2,870,079 | 1/1959 | McCall | 204/197 |
| 3,530,051 | 9/1970 | Ueda et al. | 204/147 |
| 3,616,418 | 10/1971 | Anderson et al. | 204/196 |
| 3,769,521 | 10/1973 | Caldwell et al. | 405/211 X |
| 4,089,767 | 5/1978 | Sabins | 204/197 |
| 4,096,051 | 6/1978 | Annis | 204/196 |
| 4,201,637 | 5/1980 | Peterson et al. | 204/197 X |
| 4,318,787 | 3/1982 | Peterson et al. | 204/196 X |
| 4,484,838 | 11/1984 | Stevens | 405/211 X |
| 4,484,839 | 11/1984 | Nandlal et al. | 405/211 |
| 4,484,840 | 11/1984 | Nandlal et al. | 405/211 |

*Primary Examiner*—Cornelius J. Husar
*Assistant Examiner*—Nancy J. Stodola
*Attorney, Agent, or Firm*—John S. Schneider

[57] ABSTRACT

An anode pod system for cathodically protecting offshore structures and method of installing the system in which a set of anode pod units are individually placed on the ocean floor adjacent an offshore structure. Each anode pod unit comprises a plurality of anodes attached to a top tubular ring and a base tubular ring larger than the top tubular ring to form a conically-shaped unit. An electrical conductor cable connects each anode pod unit to the offshore structure.

13 Claims, 3 Drawing Figures

FIG. 2
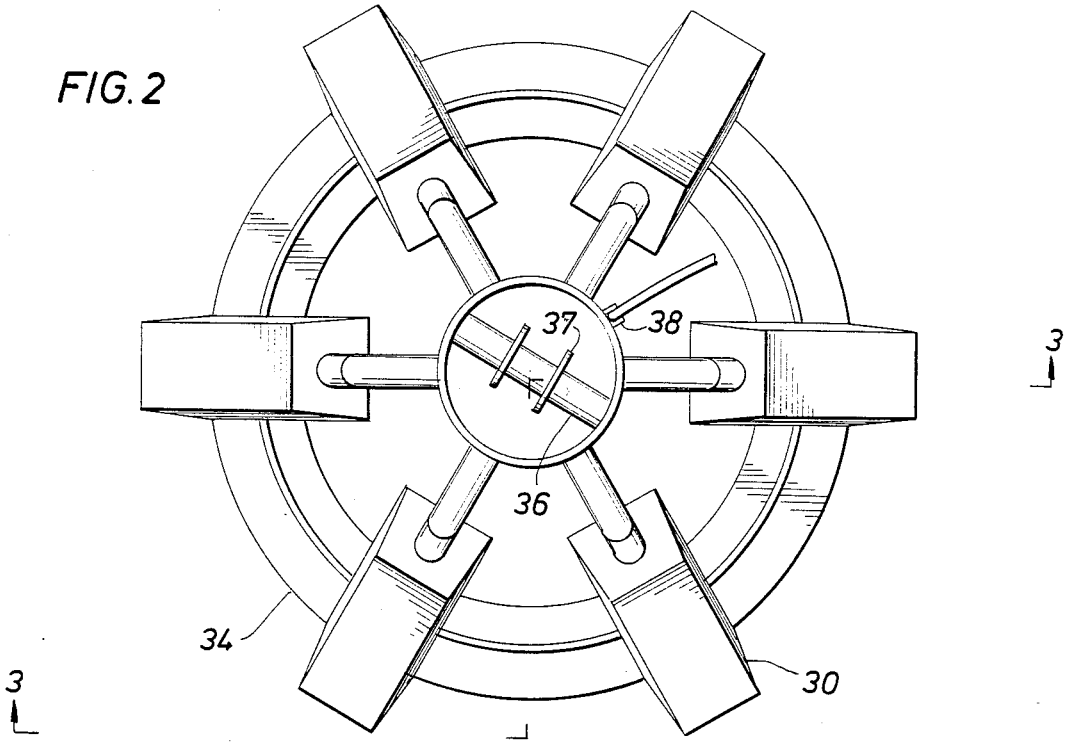
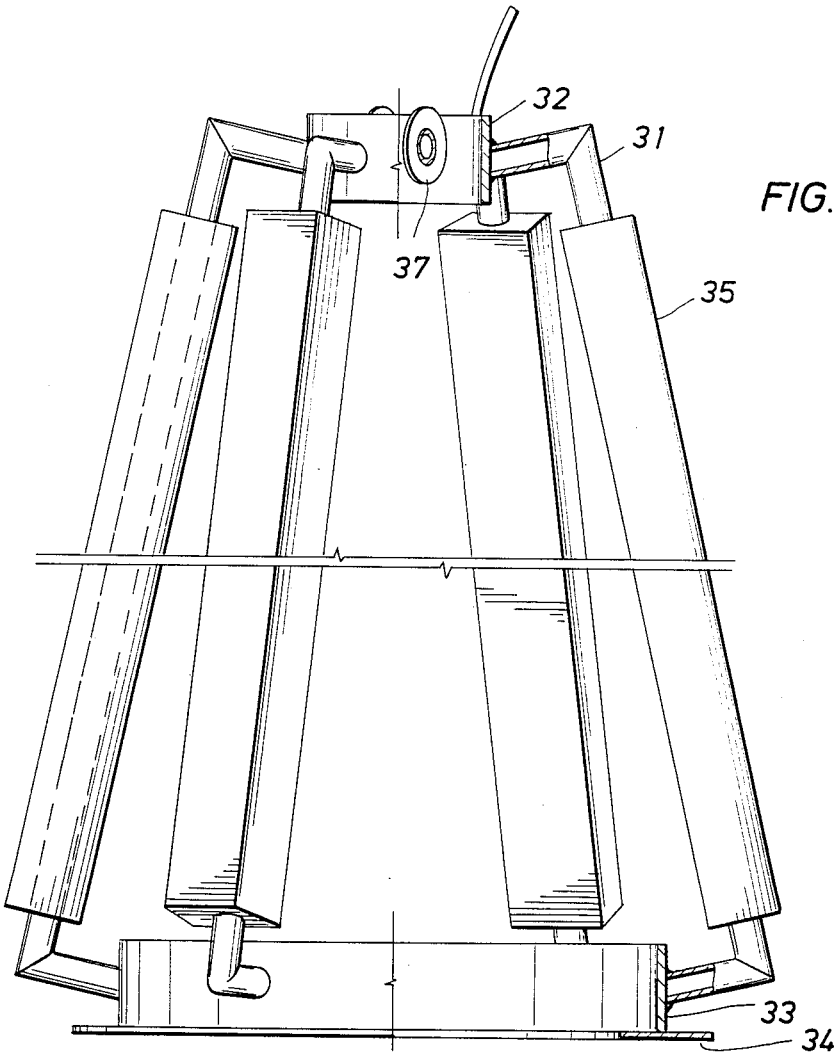
FIG. 3

ANODE POD SYSTEM FOR OFFSHORE STRUCTURES AND METHOD OF INSTALLATION

BACKGROUND OF THE INVENTION

The present invention concerns an anode pod system and method for installing such system. When installed, the system provides cathodic protection to offshore structures or platforms, such as those used in offshore oil and/or gas well drilling and production operations.

The invention involves a new concept for installation of anodes on existing offshore structures. A primary application of that concept is to improve the cathodic protection for iron or steel located near the mudline or base of such structures.

Cathodic protection systems are implemented on offshore structures to prevent the corrosion of the structural iron or steel. The use of sacrificial anodes, which are typically placed throughout the structure during onshore fabrication, has proven to be an effective method of protection. Some existing platforms, however, have anode systems which have depleted to a state in which they no longer are preventing active corrosion. Some structures have low protection throughout, while others experience the problem only in particular areas. One specific area of concern on conventional offshore drilling/production platforms is the mudline area. The lower section of a platform with battered legs has more metallic surface area, and thus requires a higher concentration of anodes. The installation of additional anodes to improve the cathodic protection in the mudline region is a difficult task and that task becomes more complex with increasing water depths.

SUMMARY OF THE INVENTION

An anode pod system for use with an offshore structure positioned on the floor of a body of water (hereinafter sometimes referred to as "ocean floor") comprises at least one anode pod having a lower tubular ring positioned on the ocean floor and an upper tubular ring and a plurality of angularly spaced-apart anodes, each connected to the upper and lower rings to form a conically-shaped pod unit. A conductor cable connects the pod to the structure.

Each pod is lowered from the water's surface to a location on the floor near the offshore structure. A series of pod units may be arranged about the perimeter of the offshore structure. The cable is preferably attached to the offshore structure before, but may be attached after, the pod unit is lowered into position on the ocean floor.

BRIEF DESCRIPTION OF THE DRAWINGS

FIG. 2 is a plan view of one of the anode pods; and

FIG. 3 is a view taken on lines 3—3 of FIG. 2.

DESCRIPTION OF THE PREFERRED EMBODIMENTS

Figure 1:
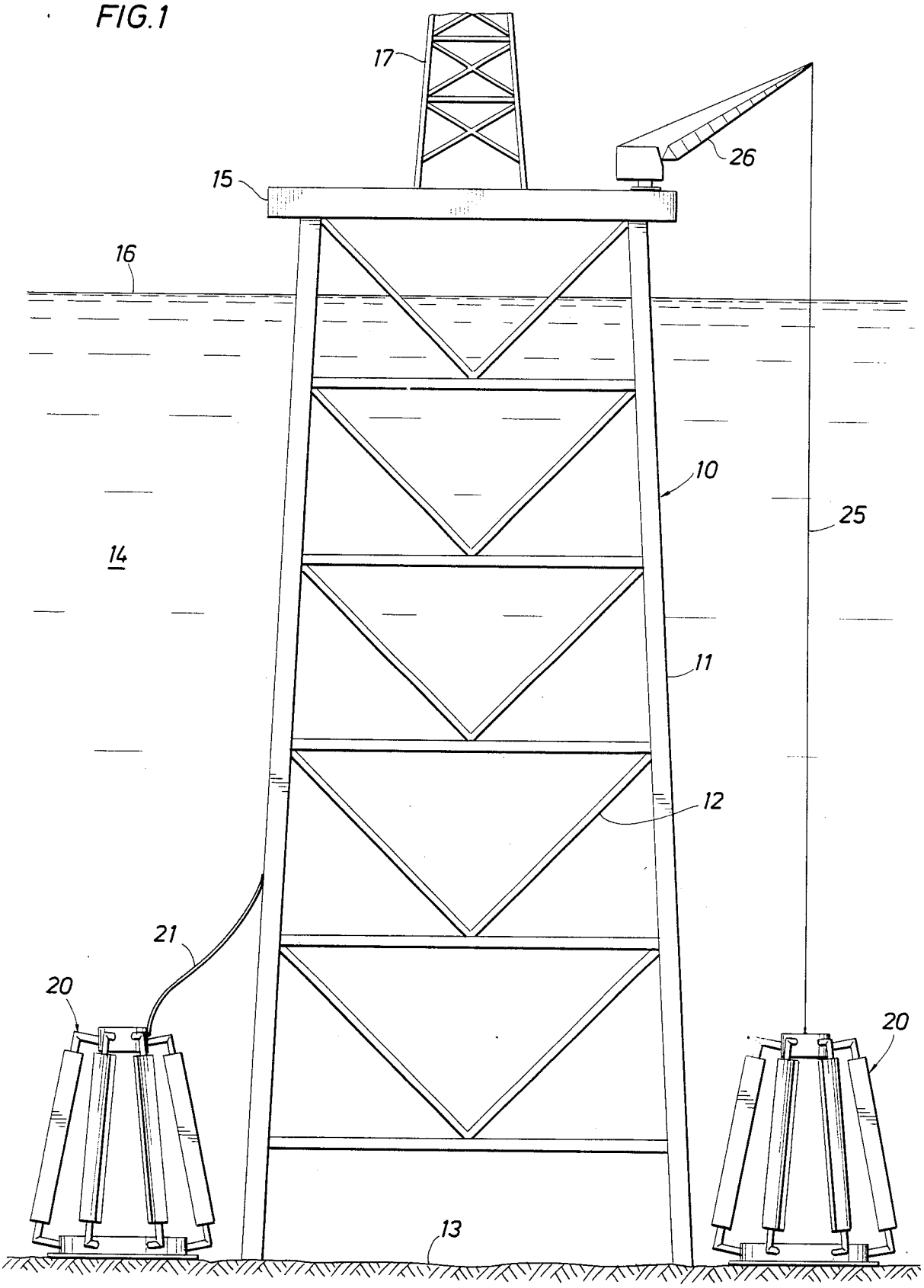
FIG. 1 is an elevation of an offshore drilling platform showing one pod unit in position on the ocean floor and the other pod unit being positioned on the ocean floor.

There is shown in FIG. 1 an offshore production or drilling platform 10, having support legs 11 and cross-bracing 12, positioned on the floor 13 of a body of water 14. A deck 15 is arranged on legs 11 above the water's surface 16, and a drilling derrick 17 is positioned on the deck.

One anode pod unit 20 is shown positioned on ocean floor 13 and connected to platform 10 by electrical conductor cable 21. Another anode pod unit 20 is shown in FIG. 1 being positioned on ocean floor 13 after being lowered to the ocean floor on a cable suspended from a crane 19 mounted on deck 15 of platform 10.

Details of the anode pod units 20 are shown in FIGS. 2 and 3. Preferably, each pod unit 20 has six anodes 30 angularly spaced-apart equal distances. Each anode includes a pipe core 31 connected at its upper end to an upper ring 32 and at its lower end to a lower ring 33. Lower ring 33 is mounted on a base plate 34. Each pipe core 31 is embedded in a soft metal anode 35. The principal metal is preferably aluminum, magnesium, zinc, or an alloy of those metals. Small quantities of other metals may be alloyed with the principal metals. A pipe 36 extends across the center of upper ring 32 and contains spaced-apart circular plates 37. The portion of pipe 40 between those circular plates may engage a releasable cable, such as cable 18, when lowering the pod unit into position on the ocean floor. Cable 21 is connected to upper ring 32 at 38. Each soft metal anode 35 is shown as rectangularly shaped. However, the anode may be formed square, circular, doughnut-shaped, or any other desired shape. The pod unit 20 is conically shaped, as shown in FIGS. 1 and 3 more clearly, for stability. The center of gravity is low and resistance to current is minimized.

As illustrative of sizing, the height of the anode unit may be about 12 feet with the upper ring 32 having a diameter of 24 inches. The lower ring 33 may have a 72-inch diameter and pipe core 31 may have a 4-inch nominal diameter. Base plate 34 may have an inside diameter of 66 inches and an outside diameter of 78 inches. The anode length may be 10 feet with an anode material weight of 1260 pounds. Nominal anode cross-section dimensions may be 10 inches by 12 inches.

The pod unit 20 can be completely fabricated at an onshore site, transported to the offshore structure location, lowered by cable to the mudline, with the cable already connected to the offshore structure. Alternatively, the cable may be connected to the offshore structure after the anode pod unit is lowered into position on the ocean floor.

The conical shape and net weight of anode unit 20 can be adjusted to conform to the stability requirements at the platform location. The size and number of anodes in each pod can vary, dependent on the required protection levels or on the type of equipment available for installation. The cathodic protection in the mudline area can be increased to the desired degree by installing several anode pods around the perimeter of the offshore structure, as indicated in FIG. 1.

Cable 21 may be welded to platform 10 or any other desired electrically-conductive connection may be employed. The connection of cable 21 to the anode pod may also be by welding or other electrically-conductive means. Also, the connections may be made to any part of the hard metal, iron or steel, of the pod unit and platform.

The anode pod system contains several features which make it an attractive method of increasing the cathodic protection in the mudline region. These features include:

Ability to fabricate the anode pods units at an onshore site.

Ability to install the pod units without the use of large marine vessels.

Ability to design the pod units as stable, self-supporting units which only require a single connection to the platform.

Ability to install a large quantity of anodes in a minimum amount of time.

Ability to adjust the size of each pod unit and the number of pod units to accommodate the protection requirements for the offshore structure. Further adjustment may be made by removing and/or adding individual anodes to any pod unit.

These features indicate that a major advantage of the anode pod system is that it allows offshore installation time to be kept at a minimum. This concept becomes increasingly efficient in deeper water depths because many anodes can be installed as a unit, thereby eliminating individual anode-to-platform connections.

Changes and modifications may be made in the illustrative embodiments of the invention shown and described herein without departing from the scope of the invention as defined in the appended claims.

We claim:

1. An anode pod system for use with an offshore structure positioned on the ocean floor, comprising:

at least one anode pod having a lower tubular ring positioned on the ocean floor, an upper smaller tubular ring and a plurality of anodes, each connected to the upper and lower rings to form a conically-shaped unit, said anode pod being supported on the ocean floor and being outside the perimeter of the base of said structure; and an electrical conductor cable means connecting said anode pod to said structure.

2. An anode pod system as recited in claim 1 in which said anodes are angularly spaced-apart equal distances.

3. An anode pod system as recited in claim 2 including a series of said units positioned on the ocean floor and spaced about the perimeter of said structure; and an electrical conductor cable connecting each pod unit to said structure.

4. An anode pod system as recited in claim 3 in which each anode comprises a metallic core and a sacrificial metallic anode surrounding said core, said core being connected to said upper and lower rings.

5. An anode pod system as recited in claim 4 in which each pod unit comprises six anodes.

6. An anode pod system as recited in claim 5 in which said anodes comprise magnesium.

7. An anode pod system as recited in claim 5 in which said anodes comprise zinc.

8. An anode pod system as recited in claim 5 in which said anodes comprise aluminum.

9. An anode pod system as recited in claim 5 in which said anodes comprise an alloy of magnesium, zinc, and aluminum.

10. A system as recited in claim 5 in which at least one anode pod is connected to said structure above the surface of the water.

11. A method for cathodically protecting the metal near the mudline of an offshore structure comprising;

lowering an anode pod unit from the water's surface to the ocean floor, said anode pod unit being supported entirely by the ocean floor and being located outside the perimeter of the base of said offshore structure, said anode pod unit protecting only the base of said offshore structure; and connecting an electrical conductor cable attached to said anode pod unit to said structure.

12. A method as recited in claim 10 including lowering a series of pod units to the ocean floor and positioning said pod units about the perimeter of said offshore structure.

13. A method as recited in claim 11 including connecting each conductor cable to said offshore structure prior to lowering said pod units to the ocean floor.

* * * * *